US010344595B2

(12) United States Patent
Kim

(10) Patent No.: US 10,344,595 B2
(45) Date of Patent: Jul. 9, 2019

(54) VANE PUMP AND DETERMINING METHOD FOR INNER PROFILE OF CAM RING COMPOSING THEREOF

(71) Applicant: MYUNGHWA IND. CO., LTD., Seoul (KR)

(72) Inventor: Sang-woo Kim, Ansan-si (KR)

(73) Assignee: MYUNGHWA IND. CO., LTD., Seoul (KR)

( * ) Notice: Subject to any disclaimer, the term of this patent is extended or adjusted under 35 U.S.C. 154(b) by 205 days.

(21) Appl. No.: 15/509,854

(22) PCT Filed: Jan. 24, 2017

(86) PCT No.: PCT/KR2017/000817
§ 371 (c)(1),
(2) Date: Mar. 9, 2017

(87) PCT Pub. No.: WO2017/131411
PCT Pub. Date: Aug. 3, 2017

(65) Prior Publication Data

US 2018/0230803 A1 Aug. 16, 2018

(30) Foreign Application Priority Data

Jan. 28, 2016 (KR) ..... 10-2016-0010572

(51) Int. Cl.
*F01C 21/10* (2006.01)
*F03C 2/00* (2006.01)
(Continued)

(52) U.S. Cl.
CPC ..... *F01C 21/106* (2013.01); *F04C 2/3442* (2013.01); *F04C 2/3446* (2013.01);
(Continued)

(58) Field of Classification Search
CPC ..... F04C 2/344; F04C 2/3442; F04C 18/344; F04C 18/3441; F04C 14/223;
(Continued)

(56) References Cited

U.S. PATENT DOCUMENTS 2,165,963 A * 7/1939 Curtis ..... F01C 21/106 418/150
3,261,227 A * 7/1966 Lomnicki ..... F01B 1/0648 74/567
(Continued)

FOREIGN PATENT DOCUMENTS

DE 102004002076 A1 8/2005

*Primary Examiner* — Theresa Trieu
(74) *Attorney, Agent, or Firm* — Revolution IP, PLLC

(57) ABSTRACT

Disclosed is a vane pump comprising a cam ring accommodated in a pump housing, a rotor accommodated rotatably with respect to a rotational shaft in the cam ring, and a plurality of vanes coupled to the rotor to discharge fluid, wherein the cam ring has a ring shaped inner profile varied between a maximum radius (Rmax) and a minimum radius (Rmin) in a circumferential direction with respect to the rotational shaft, and the ring shaped inner profile comprises: a cycloid curve passing through a maximum radius point; a circular arc passing through a minimum radius point; and a tangent line connecting the cycloid curve to the circular arc with a tangential curvature.

2 Claims, 5 Drawing Sheets

(51) Int. Cl.

| | |
|---|---|
| ***F03C 4/00*** | (2006.01) |
| ***F04C 2/00*** | (2006.01) |
| ***F04C 2/344*** | (2006.01) |
| ***F04C 14/22*** | (2006.01) |

(52) U.S. Cl.
CPC ..... *F04C 14/226* (2013.01); *F04C 2240/30* (2013.01); *F04C 2250/301* (2013.01); *F04C 2270/16* (2013.01)

(58) Field of Classification Search
CPC ..... F04C 14/226; F04C 2230/00; F04C 2240/30; F04C 2250/301; F01C 21/106
USPC ..... 418/150, 236, 238, 259, 260–261
See application file for complete search history.

(56) References Cited

U.S. PATENT DOCUMENTS

| | | | | | |
|---|---|---|---|---|---|
| 4,480,973 | A * | 11/1984 | Ishizuka | ..... | F01C 21/106 418/150 |
| 5,431,552 | A * | 7/1995 | Davis | ..... | F01C 21/106 418/150 |
| 2015/0078946 | A1* | 3/2015 | Geue | ..... | F01C 21/106 418/150 |

* cited by examiner

【FIG. 3】
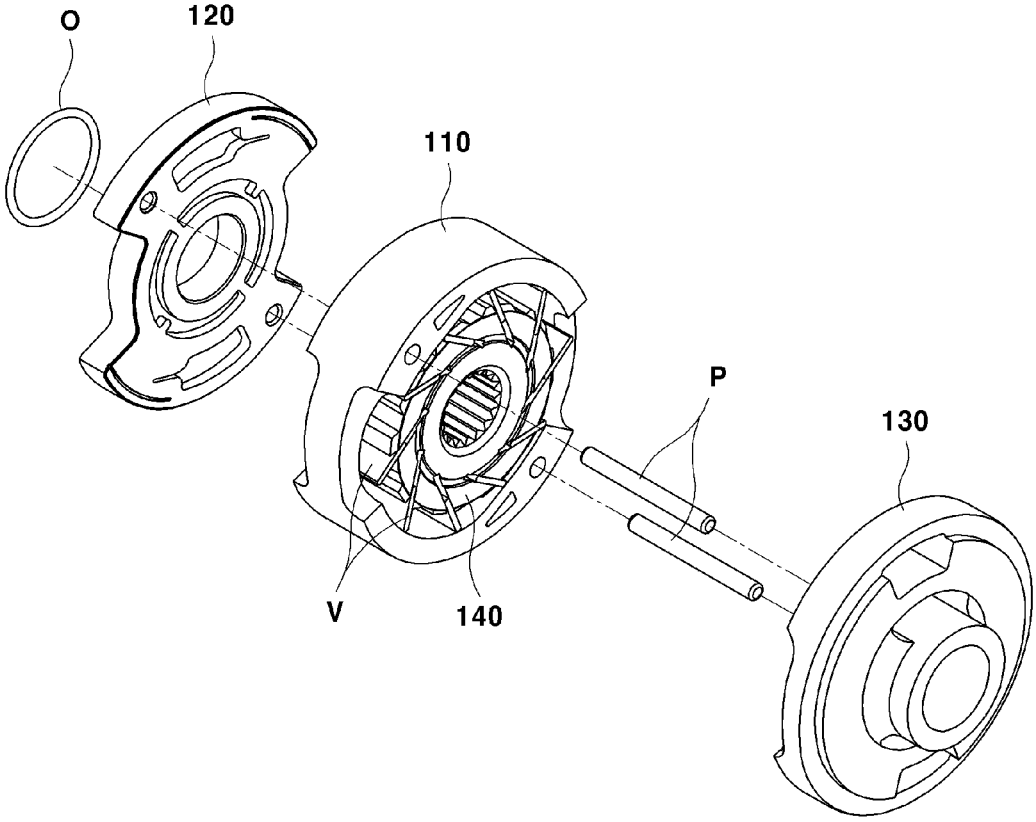
FIG. 4】
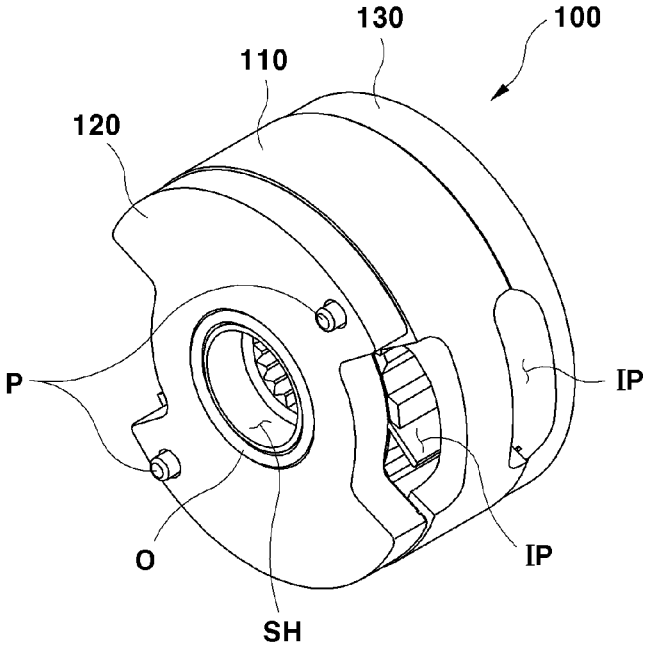

【FIG. 5】
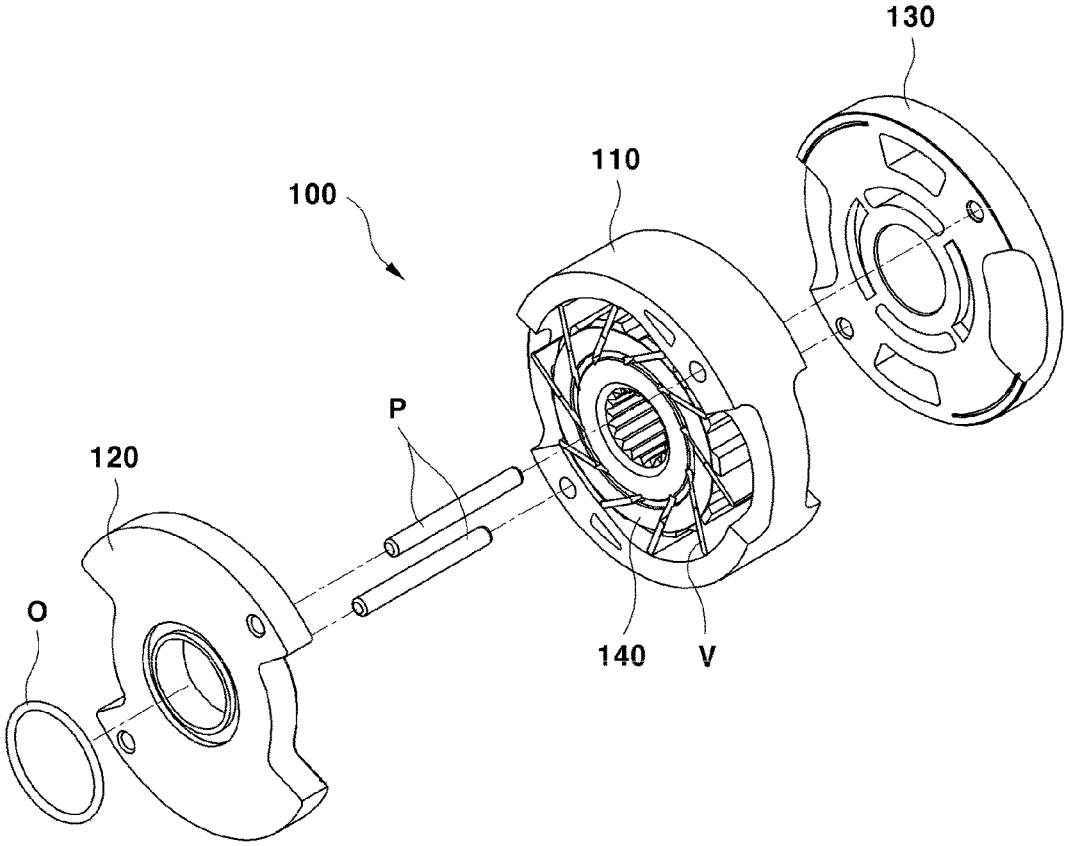

【FIG. 6】
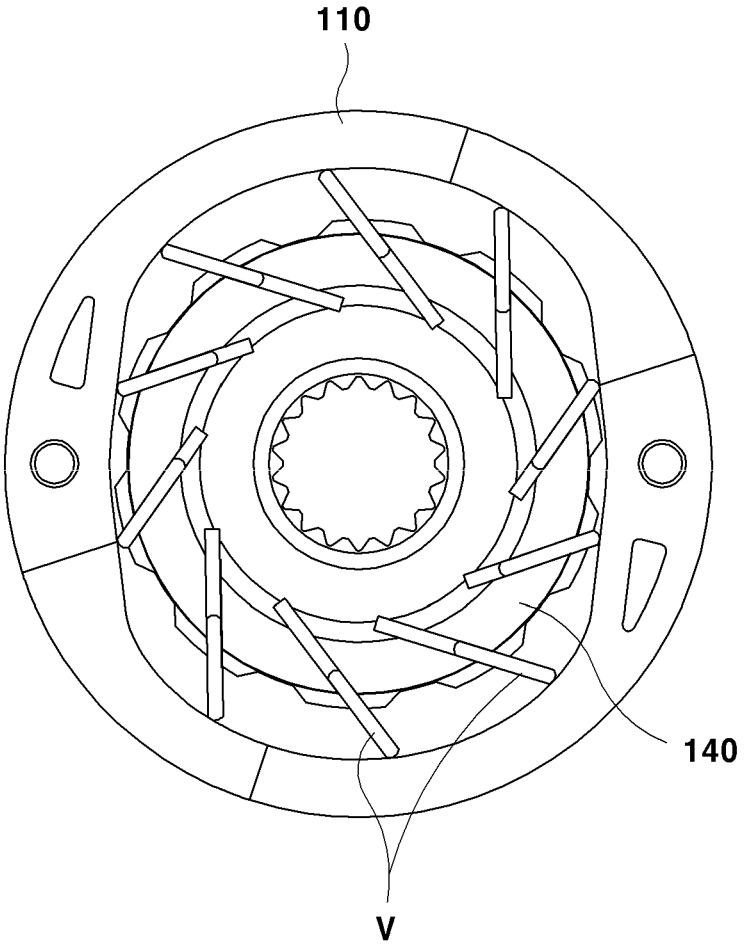

【FIG. 7】
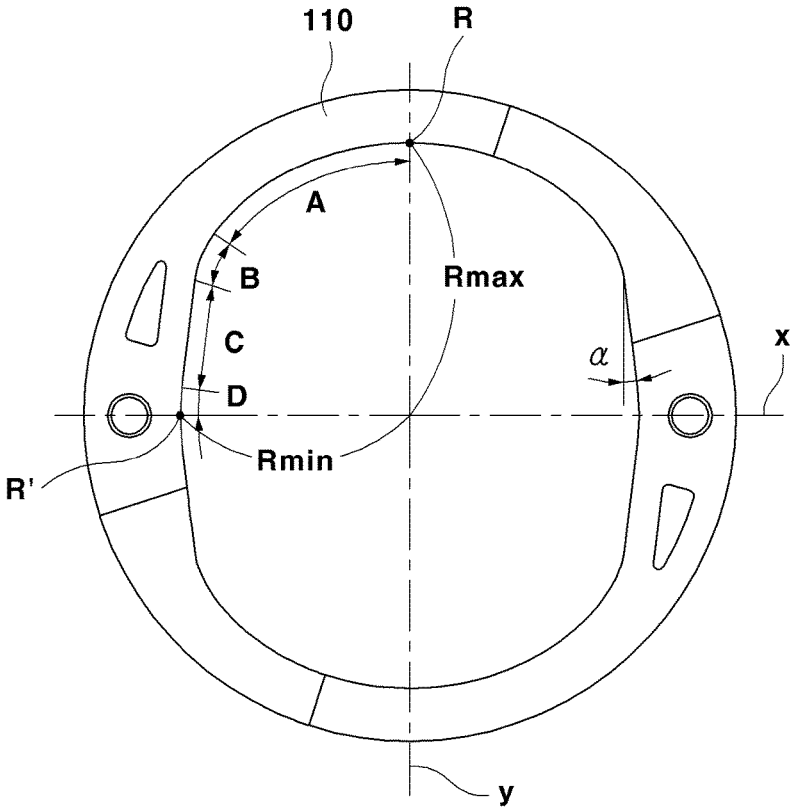
【FIG. 8】
| Classification | Typical type | New profile | New profile |
|---|---|---|---|
| External diameter of cam ring | Ø53.5 | Ø53.5 | Ø53.5 |
| Thickness of cam ring | 14 | 14 | 11 |
| Theoretical discharge amount | 10.26cc/rev | 13.03cc/rev | 10.24cc/rev |

VANE PUMP AND DETERMINING METHOD FOR INNER PROFILE OF CAM RING COMPOSING THEREOF

CROSS REFERENCE TO PRIOR APPLICATIONS

This application is a National Stage Application of PCT International Patent Application No. PCT/KR2017/000817 filed on Jan. 24, 2017, under 35 U.S.C. § 371, which claims priority to Korean Patent Application No. 10-2016-0010572 filed on Jan. 28, 2016, which are all hereby incorporated by reference in their entirety.

TECHNICAL FIELD

The present invention relates to a vane pump and a method for determining a profile of a cam ring constituting the same, and more particularly, to a vane pump capable of reducing wear of the vane pump and increasing a volume of a vane pump chamber to increase a theoretical discharge amount and a method for determining an inner profile of a cam ring constituting the same.

BACKGROUND ART

In general, a vane pump is a hydraulic oil pump, and as illustrated in FIG. 1, the vane pump includes a cam ring 8 accommodated in a pump housing (not shown) providing a case of the vane pump, a rotor 2 rotatably installed inside the cam ring 8, and a vane 4 installed to be protrudable outside the rotor 2.

Meanwhile, an introduction hole 6*a* through which oil is introduced and a discharge hole 6*b* disposed at a side opposite to the introduction hole and through which oil is discharged are defined in the cam ring 8. For example, a power steering vane pump for a commercial vehicle may have a pump efficiency that is remarkably affected according to a size and a shape of a vane and a rotor.

The operation principle of the vane pump is as follows. When the vane 4 is inserted into a vane slot of the rotor 2 at the beginning, and then the vane 4 is discharged from the vane slot due to a centrifugal force caused by rotation of the rotor 2 at the startup, while the vane 4 passes through a space provided due to a shape difference between the rotor 2 and the cam ring 8, oil is introduced through the introduction hole 6*a* and discharged through the discharge hole 6*b*.

As described above, as the rotor 2 has a circular shape, and the cam ring 8 has an inner shape of approximately ellipse, the space provided due to the shape difference between the rotor 2 and the cam ring 8 may be defined, and especially, a theoretical discharge amount may be determined according to an inner profile shape of the cam ring 8.

In detail, when the inner profile shape of the cam ring 8 is not correctly designed, the vane pump may suffer from wear. The design needs to be performed to have a larger volume to avoid the wear occurrence.

Accordingly, a structure capable of reducing the wear of the vane pump and increasing the volume of the vane pump chamber to increase the theoretical discharge amount is demanded.

PRIOR DOCUMENTS

German Patent Publication No. DE 10 2004 002 076 A1 (Aug. 11, 2005)

DISCLOSURE OF THE INVENTION

Technical Problem

The purpose of the present invention is to provide a vane pump capable of reducing wear of the vane pump and increasing a volume of a vane pump chamber to increase a theoretical discharge amount and a method for determining an inner profile of a cam ring constituting the same.

Technical Solution

An embodiment of the present invention provides a vane pump including a cam ring accommodated in a pump housing, a rotor accommodated rotatably with respect to a rotational shaft in the cam ring, and a plurality of vanes coupled to the rotor to discharge fluid. Here, the cam ring has a ring shaped inner profile varied between a maximum radius Rmax and a minimum radius Rmin in a circumferential direction with respect to the rotational shaft, and the ring shaped inner profile includes: a cycloid curve passing through a maximum radius point; a circular arc passing through a minimum radius point; and a tangent line connecting the cycloid curve to the circular arc with a tangential curvature.

In an embodiment, the cycloid curve may be determined by x and y coordinates obtained by Mathematical equation 1 below.

$$x=R(\theta-\sin\theta)-\pi R$$

$$y=R(1-\cos\theta)+KR \qquad \text{[Mathematical equation 1]}$$

(where, R is a radius of a generating circle drawing a cycloid curve, θ is an angle of a parameter, and K is a constant of 1.5 to 3)

In an embodiment, the tangent line may be inclined at an angle of 4° to 15° with respect to a radius connecting a center of the rotational shaft to the maximum radius point.

In an embodiment of the present invention, a method for determining an inner profile of a cam ring of a vane pump including a cam ring accommodated in a pump housing, a rotor accommodated rotatably with respect to a rotational shaft in the cam ring, and a plurality of vanes coupled to the rotor to discharge fluid, in which the cam ring has a ring shaped inner profile varied between a max radius Rmax and a minimum radius Rmin in a circumferential direction with respect to the rotational shaft, the method includes: determining a maximum radius point; determining a cycloid curve passing through the maximum radius point; determining an inclined tangent line having one side connected to the cycloid curve with a tangential curvature; and determining a circular arc connected to the other side of the tangent line with a tangential curvature to pass through a minimum radius point.

In an embodiment, the maximum radius point may be determined by a value of R and a value of K of Mathematical equation 1 below, and the cycloid curve passing through the maximum radius point may be determined by x and y coordinates obtained by the Mathematical equation 1 below.

$$x=R(\theta-\sin\theta)-\pi R$$

$$y=R(1-\cos\theta)+KR \qquad \text{[Mathematical equation 1]}$$

(where, R is a radius of a generating circle drawing a cycloid curve, θ is an angle of a parameter, and K is a constant of 1.5 to 3)

In an embodiment, the tangent line may be inclined at an angle of 4° to 15° with respect to a radius connecting a center of the rotational shaft to the maximum radius point.

Advantageous Effects

As described above, according to the present invention, the wear of the vane pump may be reduced, and the volume of the vane pump increases to increase the theoretical discharge amount.

BRIEF DESCRIPTION OF THE DRAWINGS

FIG. 3 is an exploded perspective view of FIG. 2

FIG. 4 is a second perspective view illustrating the vane pump according to an embodiment of the present invention.

FIG. 5 is an exploded perspective view of FIG. 4

FIG. 6 is an inner configuration view illustrating the vane pump according to an embodiment of the present invention.

FIG. 7 is a view illustrating a cam ring constituting the vane pump according to an embodiment of the present invention.

FIG. 8 is a table showing comparison between the typical vane pump and the vane pump according to an embodiment of the present invention.

MODE FOR CARRYING OUT THE INVENTION

The present invention may be embodied in different forms without being out of the scope, technical idea and essential features of the present invention. The preferred embodiments should be considered in descriptive sense only and are not for purposes of limitation.

It will be understood that although the terms of first and second are used herein to describe various elements, these elements should not be limited by these terms.

The terms are only used to distinguish one component from other components. For example, without departing from the scope of the present invention, a first element could be termed a second element, and similarly, a second element could be termed a first element.

The word 'and/or' means that one or more or a combination of relevant constituent elements is possible.

It will also be understood that when an element is referred to as being "'connected to" or "engaged with" another element, it can be directly connected to the other element, or intervening elements may also be present.

It will also be understood that when an element is referred to as being 'directly connected to' another element, there is no intervening elements.

In the following description, the technical terms are used only for explaining a specific exemplary embodiment while not limiting the present invention. The terms of a singular form may include plural forms unless referred to the contrary.

The meaning of 'include' or 'comprise' specifies a property, a number, a step, a process, an element, a component, or a combination thereof in the specification but does not exclude other properties, numbers, steps, processes, elements, components, or combinations thereof.

Unless terms used in the present disclosure are defined differently, the terms may be construed as meaning known to those skilled in the art.

Terms such as terms that are generally used and have been in dictionaries should be construed as having meanings matched with contextual meanings in the art. In this description, unless defined clearly, terms are not ideally, excessively construed as formal meanings.

Hereinafter, embodiments disclosed in this specification is described with reference to the accompanying drawings, and the same or corresponding components are given with the same drawing number regardless of reference number, and their duplicated description will be omitted.

Moreover, detailed descriptions related to well-known functions or configurations will be ruled out in order not to unnecessarily obscure subject matters of the present invention.

Figure 1:
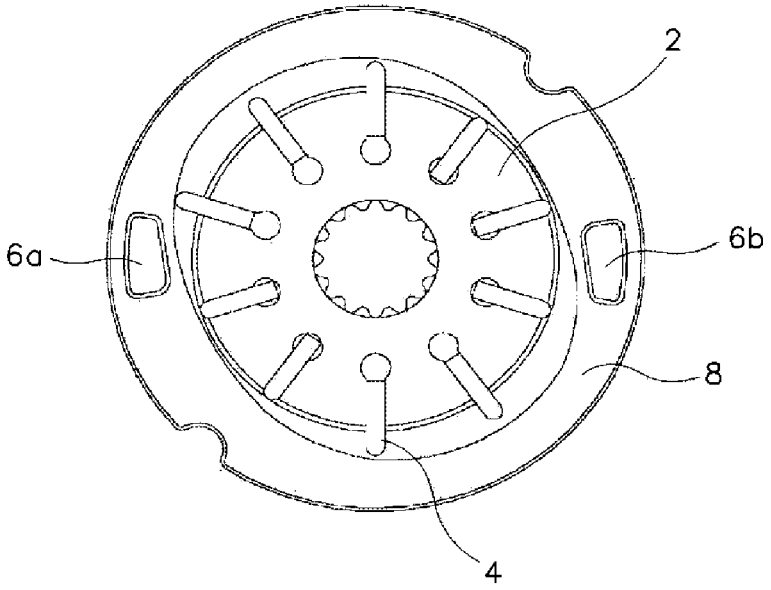
FIG. 1 Prior Art
FIG. 1 is an inner configuration view illustrating a typical vane pump.
Figure 2:
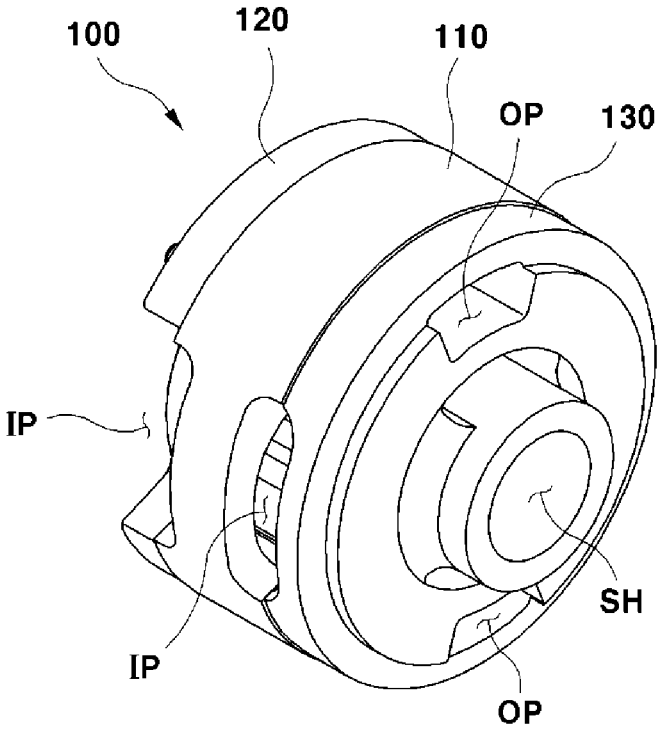
FIG. 2 is a first perspective view illustrating a vane pump according to an embodiment of the present invention.

According to an embodiment of the present invention, as illustrated in FIGS. 2 and 5, a vane pump 100 includes: a cam ring 110 accommodated in a pump housing (not shown); a rotor 140 shaft-coupled to a rotational shaft (not shown) and accommodated rotatably with respect to the rotational shaft in the cam ring 110; a plurality of vanes V coupled to the rotor 140 to discharge fluid; and an upper plate 120 and a lower plate 130 which are assembled by and an alignment pin P provided to each of both sides of the cam ring 110.

The vane pump 100 is constituted in such a manner that as the rotational shaft shaft-coupled to the rotor 140 through a shaft hole SH rotates, the rotor 140 rotates in the cam ring 110.

As an end of the plurality of vanes V rotates by rotation of the rotor 140 while being closely attached to an inner surface of the cam ring 110, fluid may be introduced through an input port IP and then discharged through a discharge port OP.

Meanwhile, the cam ring 110 constituting the vane pump 100 according to an embodiment of the present invention has a ring shaped inner profile varied between a maximum radius Rmax and a minimum radius Rmin in a circumferential direction with respect to the rotational shaft to reduce wear caused by contact and increase a volume for fluid residence, thereby increasing a theoretical discharge amount.

In detail, the ring shaped inner profile includes a cycloid curve (section A in FIG. 7) passing through a maximum radius point R, a circular arc (section D in FIG. 7) passing through a minimum radius point R', and a tangent line (section C in FIG. 7) connecting the cycloid curve to the circular arc with a tangential curvature.

Here, the cycloid curve may be determined by x and y coordinates obtained by Mathematical equation 1 below.

$$x=R(\theta-\sin\theta)-\pi R$$

$$y=R(1-\cos\theta)+KR \qquad \text{[Mathematical equation 1]}$$

(where, R is a radius of a generating circle drawing a cycloid curve, θ is an angle of a parameter, and K is a constant of 1.5 to 3)

Also, the tangent line C may be inclined at an angle of 4° to 15° with respect to a line (y-axis) connecting a center of the rotor 130 to the maximum radius point R.

For example, when the inclination angle α of the tangent line C is less than 4°, the tangent line C itself may not be determined, and when the inclination angle α of the tangent line C is greater than 15°, the profile may not be formed because the cam ring 110 has the minimum radius Rmin greater than the maximum radius Rmax.

A method for determining the inner profile of the cam ring 110 having the ring shaped inner profile as described above will be described.

According to an embodiment of the present invention, the method for determining the inner profile of the cam ring 110 constituting the vane pump 100 includes: determining the maximum radius point R; determining the cycloid curve A passing through the maximum radius point R; determining the inclined tangent line C having one side (section B in FIG. 7) connected to the cycloid curve A with the tangential curvature; and determining the circular arc D passing through the minimum radius point R' for being connected to the other side of the tangent line C with the tangential curvature.

First, the determining of the maximum radius point R will be described.

The maximum radius point R may be determined by a value of R and a value of K of the Mathematical equation 1 below, when the value of K is less than 1.5, a volumetric efficiency of the cam ring 110 may be reduced, and when the K value is greater than 3, the vane V protrudes too much from the rotor 140 around the maximum radius point R to reduce durability.

$$x=R(\theta-\sin\theta)-\pi R$$

$$y=R(1-\cos\theta)+KR \qquad \text{[Mathematical equation 1]}$$

(where, R is a radius of a generating circle drawing a cycloid curve, θ is an angle of a parameter, and K is a constant of 1.5 to 3)

Next, the determining of the cycloid curve A passing through the maximum radius point R will be described.

The cycloid curve A may be determined by x and y coordinates obtained by the above Mathematical equation 1.

Next, the determining the inclined tangent line C having one side connected to the cycloid curve A with the tangential curvature B will be described.

While one side of the tangent line C is connected to the cycloid curve A with the tangential curvature B, the inclination angle α of the tangent line C is inclined at an angle of 4° to 15° with respect to the line (y-axis) connecting the center of the rotor to the maximum radius point R.

Next, the determining of the circular arc D passing through the minimum radius point R' for being connected to the other side of the tangent line C with the tangential curvature will be described.

The circular arc D passing through the minimum radius point R' is a circular arc of which a center is the rotor 140 and connected to the other side of the tangent line C with the tangential curvature.

That is, the determining of the inner profile of the cam ring 110 constituting the vane pump 100 according to an embodiment of the present invention may be performed in an order as follows: 1) determining the cycloid curve (refer to Mathematical equation 1); 2) determining the tangent line connected to the cycloid curve with the tangential curvature of α°; 3) determining the tangential circular arc connected to the tangent line with the tangential curvature with respect to the rotational axis (zero point); and 4) forming the ¼ profile determined through the above-described process to be symmetric with respect to x and y axes to complete the ring shaped profile.

As illustrated in FIG. 8, the above-described vane pump according to the present embodiment may increase in theoretical discharge amount in comparison with the typical vane pump.

While the present invention has been particularly shown and described with reference to the accompanying drawings according to exemplary embodiments, it will be understood by those of ordinary skill in the art that various changes in form and details may be made therein without departing from the spirit and scope of the present invention as defined by the following claims. Therefore, these embodiments are provided so that this disclosure will be thorough and complete, and will fully convey the scope of the present invention to those skilled in the art. Further, the present invention is only defined by scopes of claims.

The invention claimed is:

1. A vane pump comprising a cam ring accommodated in a pump housing, a rotor accommodated rotatably with respect to a rotational shaft in the cam ring, and a plurality of vanes coupled to the rotor to discharge fluid, wherein the cam ring has a ring shaped inner profile varied between a maximum radius (Rmax) and a minimum radius (Rmin) in a circumferential direction with respect to the rotational shaft, and the ring shaped inner profile comprises:

a cycloid curve passing through a maximum radius point;

a circular arc passing through a minimum radius point; and a tangent line connecting the cycloid curve to the circular arc with a tangential curvature, wherein the cycloid curve is determined by x and y coordinates obtained by Mathematical equation 1 below $$x=R(\theta-\sin\theta)-\pi R$$

$$y=R(1-\cos\theta)+KR \qquad \text{[Mathematical equation 1]}$$

(where, R is a radius of a generating circle drawing a cycloid curve, θ is an angle of a parameter, and K is a constant of 1.5 to 3).

2. The vane pump of claim 1, wherein the tangent line is inclined at an angle of 4° to 15° with respect to a radius connecting a center of the rotational shaft to the maximum radius point.

* * * * *